US006821085B2

(12) United States Patent
Darkins, Jr. et al.

(10) Patent No.: US 6,821,085 B2
(45) Date of Patent: Nov. 23, 2004

(54) TURBINE ENGINE AXIALLY SEALING ASSEMBLY INCLUDING AN AXIALLY FLOATING SHROUD, AND ASSEMBLY METHOD

(75) Inventors: Toby George Darkins, Jr., Loveland, OH (US); Mary Ellen Alford, Cincinnati, OH (US); Mark Eugene Noe, Morrow, OH (US)

(73) Assignee: General Electric Company, Schenectady, NY (US)

( * ) Notice: Subject to any disclaimer, the term of this patent is extended or adjusted under 35 U.S.C. 154(b) by 80 days.

(21) Appl. No.: 10/260,599

(22) Filed: Sep. 30, 2002

(65) Prior Publication Data

US 2004/0062640 A1 Apr. 1, 2004

(51) Int. Cl.[7] ..... F01D 11/08

(52) U.S. Cl. ..... 415/173.1; 415/173.3; 415/116

(58) Field of Search ..... 415/126, 127, 415/173.1, 174.1, 116, 173.2, 200, 213.1, 173.3; 29/889.2, 889.21, 889.22

(56) References Cited

U.S. PATENT DOCUMENTS

| | | | | | |
|---|---|---|---|---|---|
| 3,583,824 | A | * | 6/1971 | Smuland et al. | 415/173.1 |
| 3,798,899 | A | | 3/1974 | Hill | |
| 3,807,891 | A | | 4/1974 | Mcdow et al. | |
| 3,966,353 | A | | 6/1976 | Booher, Jr. et al. | |
| 4,157,232 | A | * | 6/1979 | Bobo et al. | 415/116 |
| 4,193,738 | A | | 3/1980 | Landis, Jr. et al. | |
| 4,325,647 | A | | 4/1982 | Maier et al. | |
| 4,472,108 | A | * | 9/1984 | Pask | 415/173.3 |
| 4,529,355 | A | * | 7/1985 | Wilkinson | 415/173.1 |
| 4,768,924 | A | | 9/1988 | Carrier et al. | |
| 4,988,266 | A | * | 1/1991 | Nakamura et al. | 415/173.1 |
| 5,071,313 | A | | 12/1991 | Nichols | 145/173.3 |
| 5,074,748 | A | | 12/1991 | Hagle | |
| 5,127,793 | A | | 7/1992 | Walker et al. | 415/173.1 |
| 5,129,783 | A | | 7/1992 | Hayton | |
| 5,388,962 | A | | 2/1995 | Wygle et al. | |
| 5,562,408 | A | | 10/1996 | Proctor et al. | 415/173.1 |
| 5,971,703 | A | * | 10/1999 | Bouchard | 415/173.1 |
| 5,988,975 | A | * | 11/1999 | Pizzi | 415/173.1 |
| 6,000,906 | A | | 12/1999 | Draskovich | 415/200 |
| 6,142,734 | A | | 11/2000 | Lee | |
| 6,241,471 | B1 | * | 6/2001 | Herron | 415/173.1 |
| 2003/0180143 | A1 | * | 9/2003 | Um et al. | 415/173.1 |

* cited by examiner

*Primary Examiner*—Thomas Denion
*Assistant Examiner*—Thai-Ba Trieu
(74) *Attorney, Agent, or Firm*—David L. Narciso; Lee H. Sachs

(57) ABSTRACT

A turbine engine axial series of members, axially distinct at least radially outwardly, enables independent axial movement to close gaps therebetween, eliminating need for fluid seals. During engine operation, an axially forward first member surface is movable an axial movement distance to close any gap between the first member and a second member that floats axially independently of adjacent members and that is movable axially responsive to axial force from the first member. Axial movement of the second member toward a third member closes any gap therebetween, the axial length of the gap, prior to engine operation, being substantially no greater than the axial movement distance of the first member.

12 Claims, 1 Drawing Sheet

TURBINE ENGINE AXIALLY SEALING ASSEMBLY INCLUDING AN AXIALLY FLOATING SHROUD, AND ASSEMBLY METHOD

The Government has rights in this invention pursuant to Contract No. F33615-97-C-2778 awarded by the Department of Air Force.

BACKGROUND OF THE INVENTION

This invention relates generally to an assembly of turbine engine articles distinct from one another and disposed about rotating articles. One example includes a turbine shroud disposed about rotating blading members, in a series of associated, juxtaposed distinct members that can comprise a combination of a stationary nozzle with vanes, engine frames, etc.

It is typical in the turbine engine art, for example art relating to gas turbine engines, to dispose a series of generally stationary members radially outwardly from an engine axis of rotation about rotating blades to define together a part of a radially outer flowpath boundary of the engine. An example of such a series of members, axially extending in the engine and juxtaposed one with another, comprises a turbine stator or nozzle having a stage of vanes each including an outer band; a turbine shroud circumferentially about rotating turbine blades; and a turbine engine rear frame or another turbine nozzle. In many assemblies, axially adjacent members of such a series are in juxtaposition across an axial gap that requires a separate fluid seal to inhibit the radially outward flow of the engine gas stream and/or the radially inward flow of cooling air. As is well known in the gas turbine engine art, engine efficiency can be reduced by fluid losses resulting from leakage through such gaps. Some examples of U.S. Patents relating to such structures include U.S. Pat. No. 5,071,313—Nichols; U.S. Pat. No. 5,074,748—Hagel; U.S. Pat. No. 5,127,793—Walker et al.; and U.S. Pat. No. 5,562,408—Proctor et al.

Metallic type materials currently and typically are used to make members in such a series, including shrouds and shroud segments. Therefore, some engine assemblies include a series of metallic members, such as a series of stationary nozzle vanes, shrouds, and/or frames and other vanes, in contact with each other and axially loaded together to define a substantially continuous flowpath portion in the engine. One such example is shown in U.S. Pat. No. 3,807,891—McDow et al. That kind of loading or restraint can result in the application of a substantial compressive force to the members. If such members are made of typical high temperature alloys generally currently used in gas turbine engines, the alloys can easily withstand and accommodate such compressive forces. However, if one or more of the series of members is made of a low ductility, relatively brittle material, such compressive loading can result in fracture or other detrimental damage to the member during engine operation.

Current gas turbine engine development has suggested, for use in higher temperature applications such as shroud segments and other components, certain materials having a higher temperature capability than the metallic type materials currently in use. However such materials, forms of which are referred to commercially as a ceramic matrix composite (CMC), have mechanical properties that must be considered during design and application of an article such as a shroud segment. For example, as discussed below, CMC type materials have relatively low tensile ductility or low strain to failure when compared with metallic materials. Also, CMC type materials have a coefficient of thermal expansion (CTE) in the range of about 1.5–5 microinch/inch/° F., significantly different from commercial metal alloys used as restraining supports or hangers for shrouds of CMC type materials. Such metal alloys typically have a CTE in the range of about 7–10 microinch/inch/° F. Therefore, if a CMC type of shroud segment is restrained or axially loaded with an offset reaction point during engine operation, and cooled on one surface as is typical during operation, compressive forces can be developed in a CMC type segment sufficient to cause failure of the segment.

Generally, commercially available CMC materials include a ceramic type fiber for example SiC, forms of which are coated with a compliant material such as BN. The fibers are carried in a ceramic type matrix, one form of which is SiC. Typically, CMC type materials have a room temperature tensile ductility of no greater than about 1%, herein used to define and mean a low ductility material. Generally CMC type materials have a room temperature tensile ductility in the range of about 0.4–0.7%. This is compared with metallic shroud and/or supporting structure or hanger materials having a room temperature tensile ductility of at least about 5%, for example in the range of about 5–15%. Shroud segments made from CMC type materials, although having certain higher temperature capabilities than those of a metallic type material, cannot tolerate the above described and currently used type of compressive force or similar restraint force against chording. Therefore, a shroud segment assembly, in one embodiment including shroud segments of a low ductility material, floating axially independently of other engine members and positioned or disposed in a manner that does not apply detrimental force to the shroud segment during operation enables advantageous use of the higher temperature capability of CMC material. Provision of a turbine engine series of members including an intermediate member axially floating independently of adjacent members and separated prior to engine operation from an axially aft member across a selected gap can enable axial sealing of the assembly without additional seal members and without application of excessive loading or a compressive force on the intermediate member by selective axially movement of the axially floating member. This can enable successful use of a CMC material for making a member such as a shroud or shroud segment and can eliminate or at least reduce the requirement for additional, separate seals.

BRIEF SUMMARY OF THE INVENTION

One form of the present invention provides a combination of an axially disposed series of members in a turbine engine. The engine comprises a compressor section for compressing incoming fluid, a combustion section for burning fuel with the fluid to generate products of combustion or combustion gases, and a turbine section for extracting energy from the products of combustion. Each of the axially disposed series of members is axially distinct from an adjacent juxtaposed member at least at a radially outer portion. The combination comprises a series of three respectively juxtaposed members. One is an axially forward first member, for example a non-rotating nozzle. A second is an axially middle or intermediate second member, for example a shroud or shroud segment, floating independently axially. A third is an axially aft third member, for example another non-rotating nozzle or a portion of a turbine aft frame, separated prior to engine operation from the second member by a gap.

The first member includes a radially outer portion having an axially aft surface, and a radially inner portion held by the engine. Thus the radially outer portion is cantilevered from its radially inner portion, the axially aft surface of the first member being free to move a first axial length or movement distance axially aft as a result of typical aeronautical force or load applied to the first member during engine operation. Such axial movement of the first member radially outer portion reduces any first gap of first gap axial length that may exist after assembly between such portion and a juxtaposed portion of the second member. In addition, such movement applies force to move the axially floating second member a second axial length or movement distance. If substantially no gap exists between the first and second members, the second axial length is substantially the same as the first axial length.

The second member, floating independently axially of the other members, includes an axially forward surface in juxtaposition and for registry with the axially aft surface of the first member, and an axially aft surface. As assembled prior to engine operation, the aft surface of the first member and the forward surface of the second member can be in contact or can be separated by an axial gap, as mentioned above.

The third member includes an axially forward surface disposed prior to engine operation axially across a second gap, of pre-selected second gap axial length, with the second member axially aft surface. The second gap axial length of the second gap is selected, prior to engine operation, as a function of the first axial length or movement distance to substantially close any gaps between the second and third members during engine operation.

Another form of the present invention provides a method of assembling a turbine engine including the above-described series of members to provide at least the gap between the second and third members of the third axial length.

DETAILED DESCRIPTION OF THE INVENTION

The present invention will be described in connection with an axial flow gas turbine engine for example of the general type shown and described in the above identified Proctor et al patent. Such an engine comprises a plurality of cooperating engine members and their sections in serial flow communication generally from forward to aft, including one or more compressors, a combustion section, and one or more turbine sections disposed axisymmetrically about a longitudinal engine axis. Accordingly, as used herein, phrases using the term "axially", for example "axially forward" and "axially aft", are directions of relative positions in respect to the engine axis; phrases using forms of the term "circumferential" refer to circumferential disposition generally about the engine axis; and phrases using forms of the term "radial", for example "radially inner" and "radially outer", refer to relative radial disposition generally from the engine axis.

It has been determined to be desirable to use low ductility materials, such as the above-described CMC type materials for selected articles or components of advanced gas turbine engines, for example non-rotating turbine shroud segments. However, because of the relative brittle nature of such materials, conventional mechanisms currently used for attaching or securing metallic forms of such components with the engine structure cannot be used: relatively high mechanical, thermal and contact stresses can result in fracture of the brittle materials, as discussed above. Forms of the present invention provide an assembly of such articles, in one embodiment including articles or components made of a low ductility or brittle material, that can eliminate or at least reduce the requirement for additional seals between an axial series of articles and that avoids application of undesirable stresses to an article.

Figure 1:
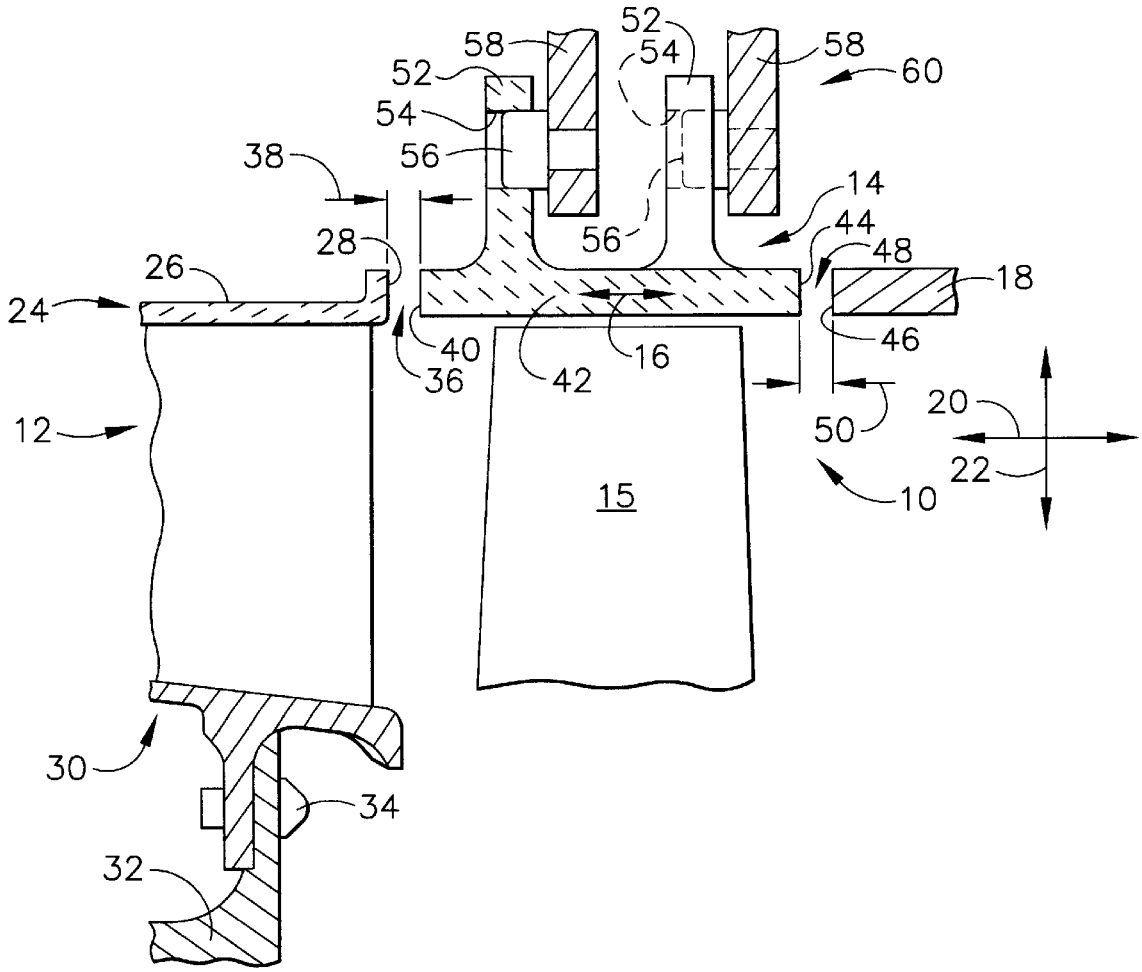
FIG. 1 is a fragmentary, partially sectional view of a portion of a turbine engine turbine section assembly including a series of members comprising, in axial sequence, a non-rotating turbine vane, an axially floating turbine shroud, and a portion of a turbine rear frame, after assembly and prior to engine operation.

Embodiments of the present invention will be described in connection with an axial series of articles or members in a gas turbine engine turbine section, including a shroud or shroud segment made of a low ductility material. The fragmentary, partially sectional view of FIG. 1 shows a portion of a turbine section series of separate and distinct juxtaposed members, shown generally at 10, prior to engine operation. Turbine section member series 10 comprises a non-rotating turbine nozzle shown generally at 12 as a first member axially forward in series 10. Axially aft of nozzle 12 in the axial member series is a shroud or shroud segment shown generally at 14 as a second member of member series 10, assembled in the engine about radially inwardly rotating blading members 15, typical of the turbine engine art. Shroud segment 14, shown in this embodiment to be made of a low ductility material such as a CMC, floats axially forward and aft independently of other members in series 10, as represented by arrow 16. Axially aft of shroud segment 14 in this embodiment is a portion of non-rotating turbine rear frame 18 as a third member in member series 10. In the embodiment of the drawings, orientation of member series 10 in a turbine engine is shown by engine direction arrows 20 and 22 representing, respectively, the engine axial and radial directions.

Turbine nozzle first member 12 includes a radially outer portion shown generally at 24, for example including outer band 26, having an axially aft surface 28. First member 12 also includes a radially inner portion shown generally at 30 held by a portion of the engine frame 32, for example at securing means 34 such as a pinned arrangement. Radially inner portion 30 of first member 12 is held axially and radially as well as circumferentially in respect to the engine to assist in defining the engine flowpath passing between outer and inner portions 24 and 30 axially downstream through the engine. However, outer portion 24, in contrast with known and typical turbine engine assemblies that secure an outer portion of a turbine nozzle from movement, is cantilevered from engine frame 32. As a result, outer portion 24, in this embodiment including outer band 26, is free to move or rotate generally about securing means 34 axially aft as a result of the typical aeronautical force or load exerted on nozzle 12 during engine operation.

Resulting axial movement of aft surface 28 of first member 12 toward shroud segment second member 14 closes any first gap 36, having a first gap axial length 38, existing prior to engine operation between surface 28 and an axially forward surface 40 of shroud segment 14. It should be understood, however, that gap 36 substantially may not exist if nozzle 12 and shroud segment 14 are assembled with surfaces 28 and 40 in substantial contact.

Second member 14 in this embodiment is a shroud segment shown to be made of a low ductility material such as a CMC and floating axially forward and aft between first member 12 and third member or turbine rear frame 18. In FIG. 1, shroud segment 14 comprises a shroud segment body 42 including the axially forward surface 40 and an axially aft surface 44 in axial spaced apart juxtaposition with axially forward surface 46 of third member rear frame 18 across a second gap 48 of a second gap axial length 50.

Third member 18 in this embodiment is shown to be a turbine engine rear frame, although in the series of members of the present invention it can be another non-rotating member such as a turbine nozzle followed by another turbine shroud segment, etc. For example, such an assembly is shown in the above-identified Proctor et al. patent.

In the embodiment of the drawing, shroud segment 14 includes axially spaced-apart support ribs 52 secured with and extending radially outwardly from shroud segment body 42. Included through ribs 52 are passages 54 in which are releasably disposed support pins 56 secured with a shroud hanger 58 to provide shroud assembly 60. Because shroud segment 14 is releasably carried by support pins 56 in passages 54 and pins 56 are secured with shroud hanger 58, shroud segment 14 floats independently axially forward and aft on support pins 56. Accordingly, shroud segment 14 is free to move axially during engine operation as shown by arrow 16 responsive to external forces or loads acting on shroud segment 14.

Figure 2:
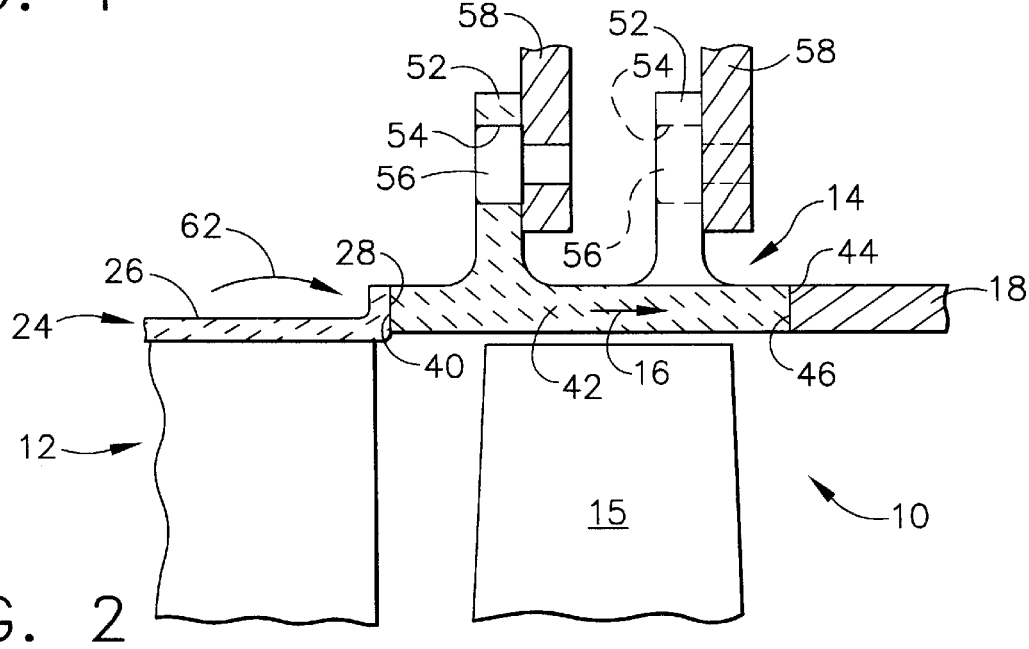
FIG. 2 is a fragmentary, partially sectional view of the assembly of FIG. 1 during engine operation.

FIG. 2 is a fragmentary, partially sectional view of the embodiment of FIG. 1 during operation of the turbine engine in which typical and well-known axial aeronautical forces and loads are applied to members of the engine. During engine operation such operating forces, in the embodiment of the present invention, move radial outer portion 24, for example outer band 26 of first member or nozzle 12, generally axially aft as shown by arrow 62.

Such axial movement is for a total axial movement distance or length predetermined, for example during prior engine or component testing, from engine design and operating conditions. Predetermination or selection of such total operating axial movement distance of outer portion 24 of first member 12 enables relative axial assembly and positioning, relative to the first member, of the second and third members in member series 10, in accordance with a form of the present invention. Such assembly brings juxtaposed surfaces of such members into registry and gaps between adjacent members are closed during engine operation. In this way, the need for additional sealing members in gaps is eliminated. In addition, when a member in the series, such as second member or shroud 14, is made of a low ductility material that can be damaged by application of loads typically experienced in a turbine engine during operation, the present invention provides a combination of the low ductility member floating independently axially in respect to the other members, along with spacing selected between members to close gaps and at the same time avoid excessive load between members. In a preferred form, adjacent, juxtaposed members are positioned axially across axial gaps, the total length of which substantially is the sum of the total operating axial movement of the first member.

In FIG. 2, axial aft movement 62 of first member outer band 26 closes any first gap 36 between first member 12 and second member 14, bringing into contact surface 28 of first member 12 and surface 40 of second member 14. In this way, the need for a fluid seal member at the point in the assembly is eliminated. Concurrently, axial aft movement 62 of surface 28 moves axially independently floating second member 14 axially aft, as shown by arrow 16, a length 50, FIG. 1, sufficient to bring aft surface 44 of second member 14 substantially into contact with forward surface 46 of third member 18, thereby closing second gap 48. As a result, the need for a fluid seal between second member 14 and third member 18 is eliminated. As was mentioned, in one embodiment of the present invention, an intermediate, second member 14 is made of a low ductility material such as a CMC. In such form, members in the series 10 are assembled and pre-positioned axially to close gaps 36 and 48 substantially without application of a force or load on second member 14 sufficient to result in undesirable damage such as fracture or cracking of the second member.

Although the present invention has been described using specific examples, materials and combination of members or structures, it should be understood that they are intended to be typical of, rather than in any way limiting on the scope of the invention. Those of ordinary skill in the various arts involved, for example high temperature metallic and non-metallic materials, their properties, and their use in gas turbine engines, will understand that the invention is capable of variations and combinations without departing from the scope of the appended claims.

What is claimed is:

1. In a turbine engine comprising a compressor section for compressing incoming fluid, a combustion section for burning fuel with the fluid to generate combustion gases, and a turbine section for extracting power from the combustion gases, a combination of an axially juxtaposed series of members respectively axially distinct one from another at least at a radially outer portion, the combination comprising:

an axially forward first member having a radially outer portion including an axially aft first surface and a radially inner portion held by the engine, the radially outer portion being cantilevered from the radially inner portion to enable axial aft movement of the axially aft first surface of the outer portion a first axial movement distance as a result of force applied to the first member during engine operation;

an axially middle second member including an axially forward second surface, in juxtaposition for registry with the axially aft first surface of the first member, and an axially aft third surface, the second member floating axially in the engine independently of adjacent members in the series of members; and, an axially aft third member including an axially forward fourth surface in juxtaposition for registry during engine operation with the axially aft third surface of the second member across a second gap between the axially aft third surface of the second member and the axially forward fourth surface of the third member of a second gap axial length prior to engine operation;

the second gap axial length being selected for assembly of the series of members prior to engine operation to be substantially no greater than the first axial movement distance.

2. The turbine engine of claim 1 in which:

the axially aft first surface of the first member is juxtaposed for registry with the axially forward second surface of the second member across a first gap of a first gap axial length prior to engine operation; and, the sum of the first gap axial length and the second gap axial length prior to engine operation is substantially no greater than the first axial movement distance.

3. The turbine engine of claim 1 in which:

the first member is a turbine nozzle including a nozzle outer band at the radially outer portion, the axially aft first surface being an aft surface of the nozzle outer band; and, the second member is a shroud segment.

4. The turbine engine of claim 3 in which the shroud segment is made of a low ductility material having a low tensile ductility measured at room temperature to be no greater than about 1%.

5. The turbine engine of claim 4 in which the low ductility material is a ceramic matrix composite.

6. The turbine engine of claim 3 in which the third member is a turbine rear frame of the engine.

7. The turbine engine of claim 3 in which the third member is an additional turbine nozzle including an additional nozzle outer band, the axially forward surface of the third member being a forward surface of the additional nozzle outer band.

8. In a method of assembling a turbine engine comprising the first, second and third members of claim 1, the steps of:

determining the first axial movement distance during engine operation; and, assembling the first, second and third members in respective axial juxtaposition in the engine to include the second gap having a second gap axial length substantially no greater than the first axial movement distance.

9. The method of claim 8 in which:

the first, second and third members are assemble to include the first gap having the first gap axial length;

the sum of the first gap axial length and the second gap axial length being substantially no greater than the first axial movement distance.

10. The method of claim 8 in which:

the first member is a turbine nozzle including a nozzle outer band at the radially outer portion, the axially aft first surface being an aft surface of the nozzle outer band; and, the second member is a shroud segment.

11. The method of claim 10 in which the third member is a turbine rear frame of the engine.

12. The method of claim 10 in which the third member is an additional turbine nozzle including an additional nozzle outer band, the axially forward surface of the third member being a forward surface of the additional nozzle outer band.

* * * * *